US006463905B1

(12) United States Patent
Okubo et al.

(10) Patent No.: US 6,463,905 B1
(45) Date of Patent: Oct. 15, 2002

(54) LOW NOISE PACKAGE STORING TYPE ENGINE WORKING MACHINE

(75) Inventors: Minoru Okubo, Osaka (JP); Masahiro Saito, Osaka (JP); Shinichiro Ishida, Osaka (JP); Masato Shiokawa, Osaka (JP); Takashi Fukushima, Osaka (JP); Kouichi Kouzato, Osaka (JP)

(73) Assignee: Yanmar Diesel Engine Co., Ltd. (JP)

( * ) Notice: Subject to any disclaimer, the term of this patent is extended or adjusted under 35 U.S.C. 154(b) by 0 days.

(21) Appl. No.: 09/806,867

(22) PCT Filed: Sep. 24, 1999

(86) PCT No.: PCT/JP99/05243

§ 371 (c)(1),
(2), (4) Date: Apr. 5, 2001

(87) PCT Pub. No.: WO00/20737

PCT Pub. Date: Apr. 13, 2000

(30) Foreign Application Priority Data

Oct. 6, 1998 (JP) ..... 10-284331
Oct. 6, 1998 (JP) ..... 10-284332

(51) Int. Cl.[7] ..... F02B 77/00
(52) U.S. Cl. ..... 123/198 E; 123/41.01
(58) Field of Search ..... 165/41, 51, 128; 181/204, 200, 54 A; 123/198 E, 2, 41.7, 41.49, 41.79, 195 S, 195 C

(56) References Cited

U.S. PATENT DOCUMENTS 4,122,353 A * 10/1978 Noguchi ..... 290/1
4,503,931 A * 3/1985 Sugimoto et al. ..... 181/204

FOREIGN PATENT DOCUMENTS

| | | | | |
|---|---|---|---|---|
| JP | 53-93509 | | 8/1978 | |
| JP | 53093509 | * | 8/1978 | ..... B60K/11/08 |
| JP | 63-129137 | | 8/1988 | |
| JP | 64-3035 | | 1/1989 | |
| JP | 5-66225 | * | 9/1993 | ..... F01P/11/12 |
| JP | 9-21364 | | 1/1997 | |
| JP | 409021364 A | * | 1/1997 | ..... F02M/35/12 |
| JP | 9-250343 | | 9/1997 | |

* cited by examiner

*Primary Examiner*—Willis R. Wolfe
*Assistant Examiner*—Rebecca A Smith
(74) *Attorney, Agent, or Firm*—Sterne, Kessler, Goldstein & Fox P.L.L.C.

(57) ABSTRACT

An engine working machine formed by storing a radiator and a cooling fan, for leading heat exchange air for the radiator, in a package together with an engine and a working machine. Wherein a storage space for the engine and working machine is separate from a ventilating port, which communicates with a space between the radiator and the cooling fan. The space is shielded by partitions from an air leading space to which air is led after being passed through the radiator by the cooling fan. A cooling air leading port for externally cooling the engine and the working machine is formed in a part of the package so that outside air led from the cooling air leading port passes the storing space and is exhausted from the ventilating port to the air leading space, to which air is led after having passed through the radiator.

1 Claim, 7 Drawing Sheets

LOW NOISE PACKAGE STORING TYPE ENGINE WORKING MACHINE

FIELD OF THE INVENTION

The present invention relates to a low noise package storing type engine working machine, wherein the escape of engine noise, including intake noise and air passing through a radiator, is reduced. The low noise package includes an engine and a working machine.

RELATED ART

As shown in FIG. 2, an engine working machine 1' contains a working machine (e.g., a compressor, a dynamo or so on). The working machine 4 is connectedly attached to a water-cooling type engine 3. The working machine 4 and water-cooling engine 3 are contained in a package 2, and known in the art. Air, after exchanging heat at a radiator 5, is led into the package 2, used for externally cooling the engine 3 and the working machine 4, and then exhausted through ventilating vents (exhausting vents) 2*a*. The vents 2*a* are formed at the side and bottom surfaces of the package 2.

In these circumstances, because noise is generated when air for radiator 5 is led into the package 2, sound absorption material is placed at an air leading port 11 of the radiator 5. However, because the air A' is led from the air leading port 11 to radiator 5 almost directly, noise generated in the air leading port 11 escapes unencumbered, and consequently, the noise reducing effect is small.

Further, external cooling wind B' of the engine working machine 1' is generated by a cooling fan 6, which intakes heat exchange air A' after leaving radiator 5. However, the cooling fan 6, which feeds cooling wind, is disposed upstream of the engine 3 and the working machine 4, and therefore there is no special member to guide wind towards the engine 3 and the working machine 4. To ensure proper cooling of engine 3 and working machine 4, a lot of exhausting vents 2*a* are formed at the side and bottom surfaces of the package 2. This generates a smooth flow of external cooling wind B' for the engine 3 and the working machine 4. However, this creates a problem that noise generated from the engine 3 and so on escapes to the outside through the many exhausting vents 2*a* with cooling wind B', which has circulated in the package 2. Moreover, a problem arises because the air A' used for the heat exchanging of the radiator 5 has been warmed at the time of passing through the radiator 5. Thus, the air A', if being used as the external cooling wind B' for the engine 3 and the working machine 4, has little cooling effect.

Additionally, there is the problem of engine intake noise associated with an engine working machine. Conventionally, to reduce air intake noise, a resonator 8' is attached to a midpoint of an intake pipe of an engine.

However, the noise reduction effect of this resonator 8' is limited to a specific frequency band. Conventionally, space limitations provide for only one resonator in the narrow space of the package, which can lead to insufficient reduction of the noise in the case when there are more than one peak frequency bands of intake noise. Attaching more than one resonator to the intake pipe causes enlargement of the engine working machine. Also, it seems that more than one resonator would reduce noise of multi-frequency bands and improve the total noise reducing effect; however, in fact, each resonator vibrates by resonation, which creates noise and consequently adds to the overall radiant noise. Far from reducing the noise, such an arrangement of more than one resonator results in increased radiant noise sources and consequently acts so as to diminish the noise reduction effect.

SUMMARY OF THE INVENTION

An object of the invention is to provide a low noise package storing type engine working machine.

Therefore, according to the present invention, first, a low noise engine working machine formed by storing a radiator and a cooling fan for leading heat exchange air for the radiator in a package together with an engine and a working machine is constructed such that a storing space for the engine and the working machine excluding a ventilating port communicating to a space between the radiator and the cooling fan is shielded from an air leading space to which air is led after being passed through the radiator by the cooling fan, and a cooling air leading port for externally cooling the engine and the working machine is formed in a part of the package so that outside air led from the cooling air leading port passes the storing space for the engine and the working machine and is exhausted from the ventilating port to the air leading space to which air led after having passed through the radiator.

Next, as for an air leading port for leading air to the radiator, according to the present invention, a plurality of forward-and-backward rows of soundproof walls are formed parallel in a direction of flow of air therein, and air passages are formed in each row of the soundproof wall so as to be placed alternately with air passages formed in the forward or backward adjacent row of soundproof wall in the direction perpendicular to the flow of air. In this regard, a sectional shape of the soundproof wall formed between any adjacent two of said air passages in each row of the soundproof wall may be formed in a substantial V-like shape which opens toward the side of the radiator.

Further, as for the reduction of engine intake noise, according to the present invention, the engine intake noise reduction apparatus comprising a plurality of unified resonators is attached to an intake pipe of an engine in an engine working machine formed by storing a radiator and a cooling fan for leading heat exchange air for the radiator in a package together with the engine and a working machine. In this connection, a resonation pipe of each resonator in said noise reduction appliance may be formed as a multiplexed pipe.

Said and other features and advantages of the invention will be apparent more fully from the following description and the accompanying drawing.

BEST MODE OF CARRYING OUT THE INVENTION

This invention will be described in further detail with reference to the accompanying drawings.

Figure 1:
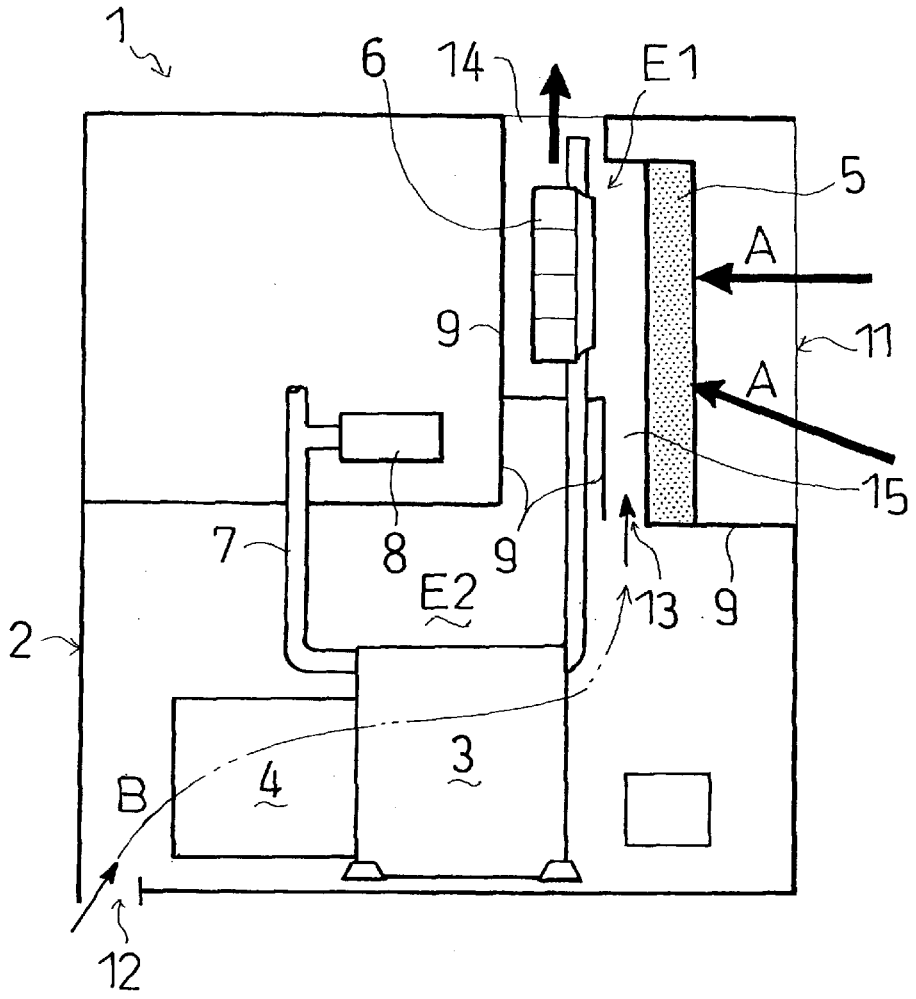
FIG. 1 is a schematic interior side view showing a low noise package storing type engine working machine 1 of the present invention.
Figure 3:
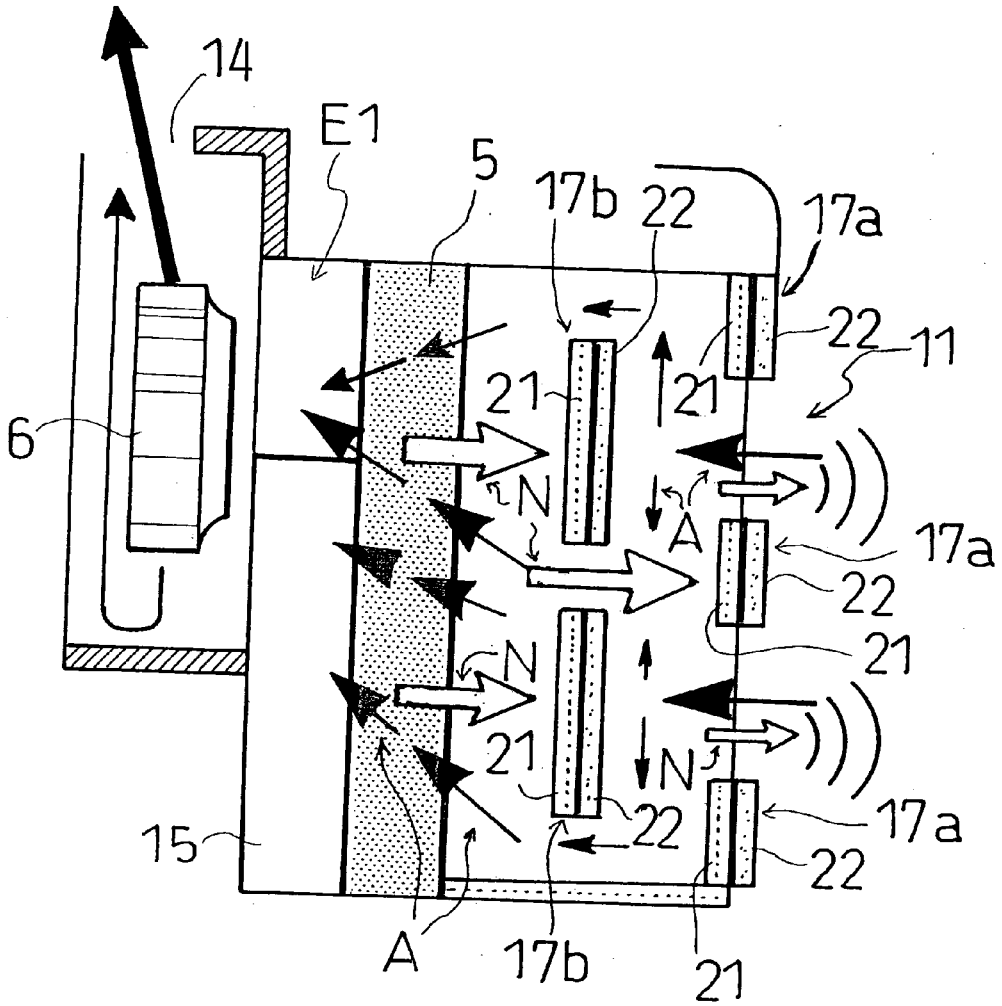
FIG. 3 is a schematic sectional side view showing an embodiment of noise reducing construction that is provided in a cooling wind leading port of a radiator.

As shown in FIGS. 1 and 3, an engine working machine 1 according to the present invention includes an engine 3, a working machine 4 e.g. a compressor or a dynamo, a radiator 5, a cooling fan 6 and so on incorporated in a package 2.

The engine 3 is mounted on the base of the package 2. The working machine 4 is connectedly attached to the output side of the engine 3 so as to be driven by the engine 3.

An intake pipe 7 is extended upward from the engine 3. In order to reduce intake air noise which is generated when inhaling air from intake pipe 7, a noise reduction appliance (a resonator) 8 is attached to the halfway of the intake pipe 7.

The radiator 5 is provided above the engine 3 on the opposite side to the working machine 4, and a cooling fan 6 is fit in the radiator 5.

Partitions 9, which partition the interior space of the package 2 into a space (a leading space of the air after having passed through the radiator) E1 and a space (a storing space for the engine and working machine) E2. The radiator 5 and the cooling fan 6 are provided in the space E1, and the engine 3, the working machine 4 and so on are provided in the space E2.

A radiator wind leading port 11 opens on one side face of the package 2 so as to face the radiator 5. By the rotation of the cooling fan 6, which is placed on the opposite side to the radiator wind leading port 11 with the radiator 5 between, heat exchange air A is led into the radiator 5 from the leading port 11, and passes through the radiator 5 while being inhaled into the cooling fan 6. An exhaust port 14 opens on a ceiling face of the package 2 placed above the cooling fan 6, and the air A after having passed through the radiator 5 is exhaled from the exhaust port 14.

A gap 15 is formed between the radiator 5 and the cooling fan 6, and a ventilating port 13, through which the space E1 communicates with the space E2, is formed at the partition 9 which is placed at the gap 15.

Moreover, a ventilating port (an air leading port) 12 opens on the base of the package 2 on the side of the working machine 4.

The cooling fan 6 inhales outside air A from the radiator wind leading port 11, and this air A is used for heat exchange of radiator 5 and is exhausted from the exhaust port 14. The space E1 is separated from the space E2 by the partitions 9, therefore, by the inhalation force of the cooling fan 6, the pressure in the space E1, especially in the gap 15 between the radiator 5 and the cooling fan 6, is negative.

Because the space E1 communicates with the space E2 by the ventilating port 13, the air A in the space E2 is inhaled into the space E1 in which the pressure is negative by the inhalation force of the cooling fan 6, and is exhaled through the exhaust port 14.

Therefore, in the space E2, outside air B is led from the air leading port 12 which opens on the base of the package 2. Then, the air B enters the space E1 through the ventilating port 13 after having passed through the working machine 4 and the engine 3 in sequence, and is exhaled from the exhaust port 14. That is, the air B, which is led into the space E2 from the air leading port 12, cools down the working machine 4 and the engine 3 in sequence as cooling wind, and is exhaled together with the above-said air A from the exhaust port 14.

Figure 2:
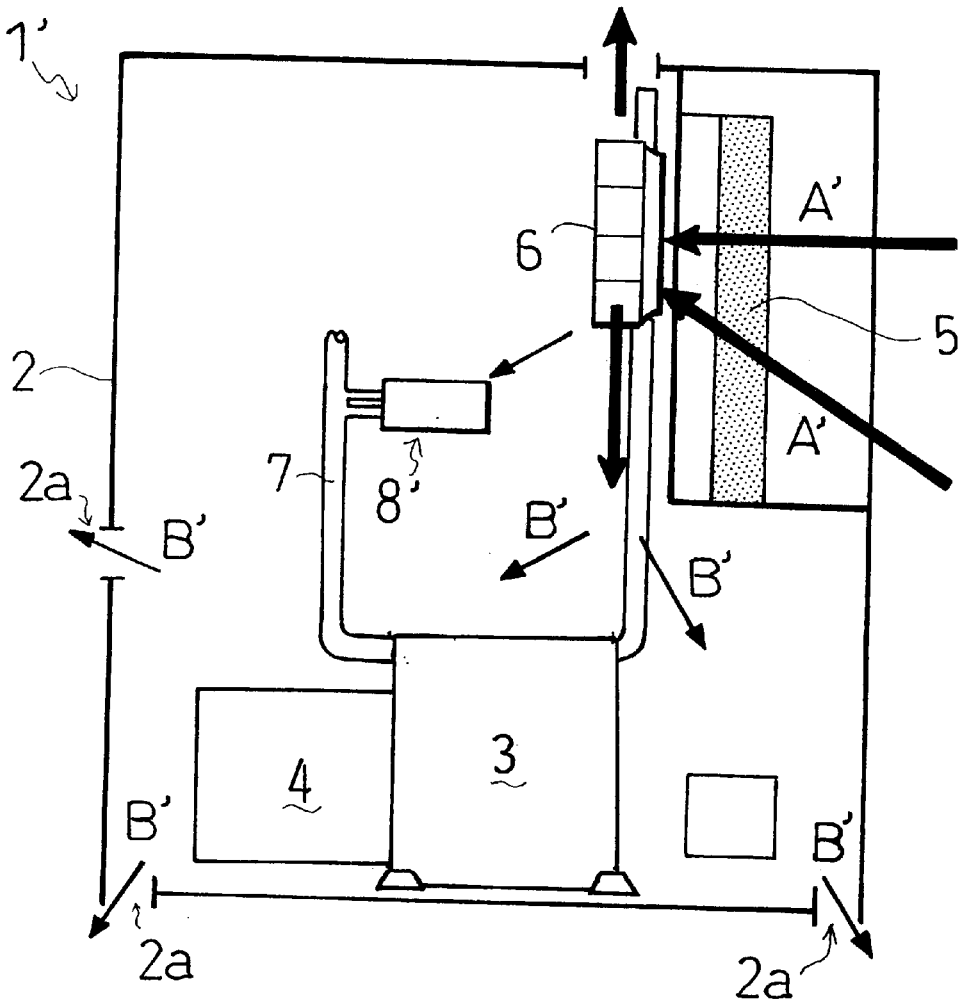
FIG. 2 is a schematic interior side view showing a conventional low noise package storing type engine working machine 1'.

Conventionally, because heat exchange air of a radiator is untouched and used for external cooling wind of an engine and a working machine, there is a problem that the circulation of the heat exchange air is poor (therefore, the necessity of forming a lot of exhausting hall results in generating factors of noise.), and cooling effect is low. In the present engine working machine 1, in the above-mentioned manner, the heat exchange air A of the radiator 5 and the external cooling air B is generated by the inhalation force of the cooling fan 6. The former air A is separated from the latter cooling wind B so as not to enter the space E1 for placing the engine and the working machine. Additionally, the negative pressure space E2 generated by the cooling fan 6 is provided at the downstream from the engine 3 and the working machine 4 in the flow of the external cooling wind B for the engine 3 and the working machine 4. The cooling wind led from the air leading port 12 securely flows into the space E2 through the ventilating port 13, thereby removing the conventional necessity of forming a lot of exhausting vents (exhausting vents 2*a* as shown in FIG. 2). Moreover, the noise of the engine 3 or the working machine 4 in the space E2 hardly escapes outside through the air leading port 12 which opens on the base of the package 2, and the air from the air leading port 12 has a low temperature such as to efficiently cool the engine 3, the working machine 4 and so on. Consequently, there can be provided the engine working machine 1 which has little outward escape of noise and has sufficient advantages in cooling and isolation.

In addition, the working machine 4 is placed nearer to the air leading port 12 (i.e. the upstream side of the cooling wind) than the engine 3. Therefore, the outside air B, which is led from the air leading port 12 and is exhaled from the ventilating port 13, flows so as to cool the hottest engine 3 after cooling the working machine 4. If the working machine were cooled by the air after cooling the hot engine, the cooling effect thereof would be small. However, in such a structure of the engine working machine 1, because the cool air B can touch the working machine 4 immediately, the working machine 4 can be cooled effectively. Consequently, a greater cooling effect of the engine 3 and the working machine 4 can be obtained.

Next, a noise reducing structure of the port (a radiator wind leading port) 11 for leading heat exchange air to the radiator will be described. As shown in FIG. 3, the radiator wind leading port 11 is formed therein with a plurality of rows (in this embodiment, two rows) of soundproof walls 17*a* and 17*b* before and behind in a longitudinal direction of leading air. Each of the soundproof walls 17*a* and 17*b* is made of a board 22 and sound absorption material 21 stuck on an inside surface (toward the radiator 5) of the board 22. The soundproof walls 17*a* and 17*b* are extended (rightward and leftward in this embodiment) substantially perpendicular to the air leading direction.

The soundproof walls 17*a* in the row disposed adjacent to the outer end of the radiator wind leading port 11, and the soundproof walls 17*b* in the row disposed inward of the soundproof wall 17*a* are arranged among gaps at substantially regular intervals serving as air passages, respectively. The front air passages among the soundproof walls 17*a* are arranged alternately with the respective rear air passages among the soundproof walls 17*b*. However, top-and-bottom ends of the air passages of the soundproof walls 17*a* overlap with those of the soundproof walls 17*b* overlap forward and backward.

In such a radiator wind leading port 11, air is led into the radiator 5 while passing through the air passages provided among the soundproof walls 17*a* and 17*b*. This flow of the air is drawn in solid arrows A in FIG. 3.

Noise is generated when the air passes through the radiator 5. The sound waves therefrom (drawn as hollow arrows N in FIG. 3) are propagated to the outer end of the leading port 11. Firstly, these sound waves N strike the sound absorption material 21 on the inside faces of the soundproof walls 17*b* and absorbed thereinto. The remaining sound waves N, which are not absorbed, pass through the air passages, and then, strike the sound absorption material 21 on the inside faces of the soundproof walls 17*a* and absorbed thereinto. The still remaining sound waves N, which are not absorbed yet, are diffracted along the outside faces of the soundproof walls 17*b* (the outside faces of the boards 22) and interfere with one another and with sound waves generated from the air led to the radiator 5, thereby being counteracted moreover. The sound caused by such counteracted sound waves escaping to the outside from the gaps among the soundproof walls 17*a* is not so loud as to be recognized as noise. In this way, the radiator wind leading port 11 of the present invention has a structure such as to reduce an escape of noise.

Figure 4:
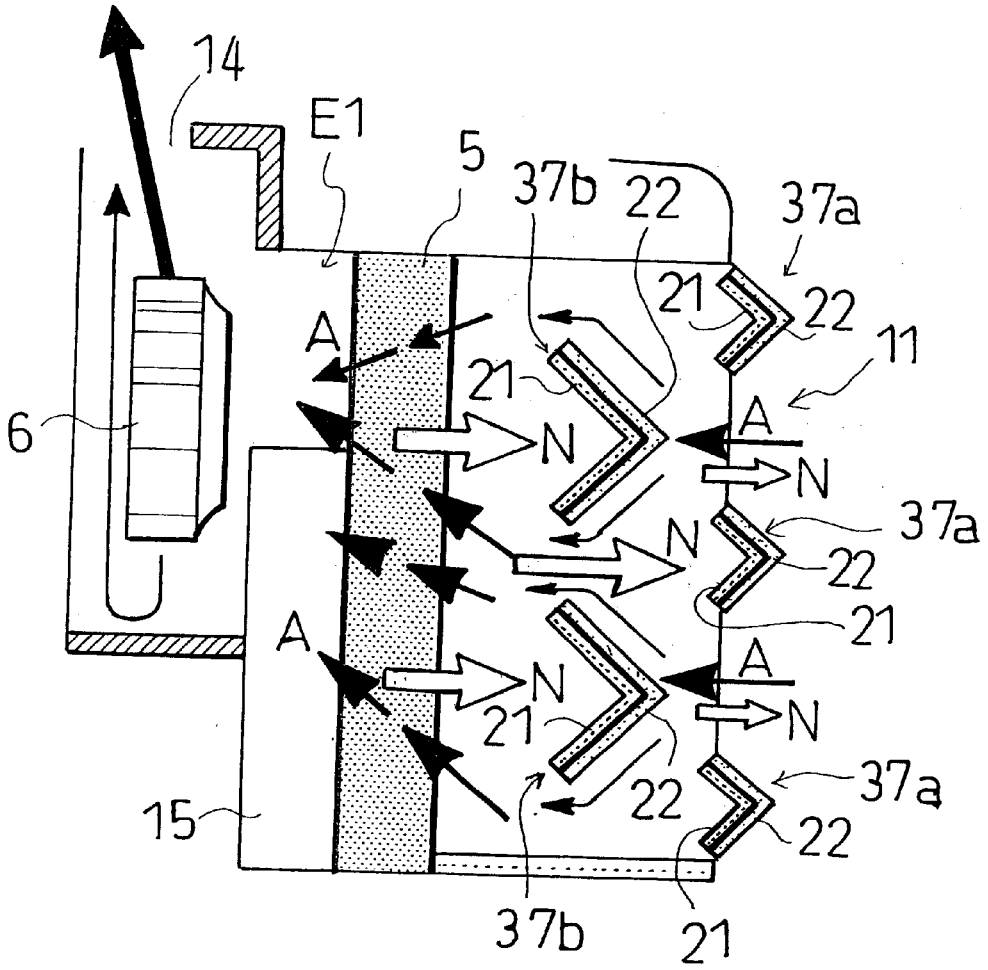
FIG. 4 is a schematic sectional side view showing another embodiment of the same.

Soundproof walls 37*a* and 37*b* shown in FIG. 4 are provided as an embodiment of the soundproof walls 17*a* and 17*b* modified in shapes for reducing a pressure loss of the air led into the radiator 5 while having the structure similar with that shown in FIG. 3 (wherein sound absorption material 21 is stuck on the inside surface of the board 22, and backward-and-forward alternate arrangement of the gaps for air passing is also adopted). Each of the soundproof walls 37*a* corresponding to the soundproof walls 17*a* and each of the soundproof walls 37*b* corresponding to the soundproof walls 17*b* are sectionally formed among the gaps into a substantial V-like shape which opens toward the side of the radiator 5.

The air A, which is led from the radiator wind leading port 11 in the structure shown in FIG. 3, before passing the gaps among the soundproof walls 17*a* and the gaps among the soundproof walls 17*b*, hits on the respective soundproof walls 17*a* and 17*b* having shapes like flat boards, and is guided into each gap along the respective outside faces of the walls 17*a* and 17*b*. The flow of the air A is bent at an angle of about 90 degrees by hitting on such flat faces of the walls 17*a* and 17*b* to be led into each gap so that the pressure loss of intake wind for the radiator tends to be large.

Therefore, soundproof walls 37*a* and 37*b* shown in FIG. 4 are formed among the gaps into substantial V-like shapes that open toward the side of the radiator 5. The outside air A which hits on the soundproof walls 37*a*, and the air A which hits on the soundproof walls 37*b* after having passed through the soundproof wall 37*a*, flows diagonally along each of the walls from the bending portions thereof to the side of the radiator 5 so as to be guided into each gap. Thus, the flow of the air A is not bent sharply, that is, it is smoothed so as to reduce the pressure loss for intake of the radiator.

Moreover, between the two rows of the soundproof walls 37*a* and 37*b*, the soundproof walls 37*a* are arranged alternately with the respective soundproof walls 37*b* while the ends of the soundproof walls 37*a* overlap with those of the soundproof wall 37*b*, thereby exerting the noise reducing effect equal to that by the above-said soundproof walls 17*a* and 17*b*.

Three or more rows of soundproof walls may be formed in the radiator wind leading port 11. In this case, all to be required is that any two adjacent front and rear rows of soundproof walls are structured as the above-mentioned structure of the soundproof walls 17*a* and 17*b* or the soundproof walls 37*a* and 37*b*, that is, backward-and-forward alternate arrangement of the gaps for air passing.

The gaps for air passing may be formed as slits extended to the port width or the port height, or may be formed as a plurality of ports. In case that the gaps are formed as ports, any shape or form is available, for example, a slot or a honeycomb. In a word, it is all right only if the forward and backward gaps are arranged alternately so that the air, which has passed through the leading gap to the side of the radiator 5, hits on the backward soundproof wall. The gaps may partly overlap.

Figure 5:
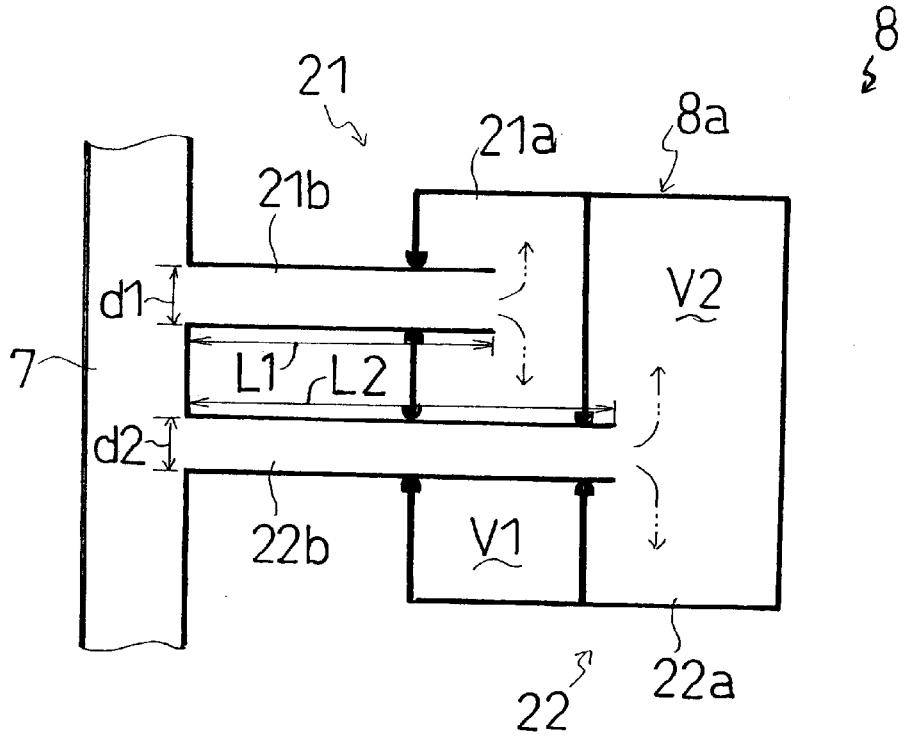
FIG. 5 is a sectional side view showing an embodiment of means to reduce engine intake noise according to the present invention.
Figure 6:
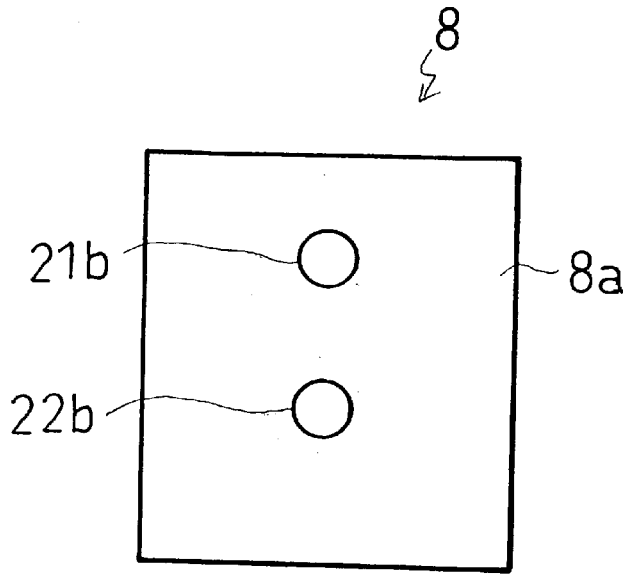
FIG. 6 is an elevation view of the same.

Next, a noise reduction appliance of the present invention will be described with reference to FIGS. 5–9. A noise reduction appliance (a dual resonator) 8 shown in FIGS. 5 and 6 is integrally formed with a first resonator 21 and a second resonator 22.

The first resonator 21 comprises a resonance pipe 21*b* which extends from the intake pipe 7, and a resonance room 21*a* which is formed at the apex portion of the resonance pipe 21*b*. The second resonator 22 comprises a resonance pipe 22*b* which extends from the intake pipe 7 and pierces the resonance room 21*a* of the first resonator 21, and a resonance room 22*a* which is formed at the apex portion of the resonance pipe 22*b*. The resonance room 21*a* and the resonance room 22*a* are formed into a unified box constituting a resonance room section 8a of the resonator 8.

That is, the resonator 8 is constructed such that the two resonance pipes 21*b* and 22*b* are projected from the resonance room section 8*a* constituted by the unified resonance rooms 21*a* and 22*a*. The resonator 8 is joined to the intake pipe 7 by connecting the resonance pipes 21*b* and 22*b* to the intake pipe 7.

The resonator 8 absorbs only noise of a specific frequency band by internal resonance, and the frequency band that can be absorbed is formularized as the resonance A frequency f in the following equation (1):

$$f = \frac{c}{2\pi}\sqrt{\frac{\pi d^2}{4} \Big/ \frac{V}{L+0.8d}} \tag{1}$$

In the equation (1), the speed of sound is designated as c, the diameter of the resonance pipe is designated as d, the length of the resonance pipe is designated as L, and the volume of the resonance room is designated on V.

The absorbable frequency band depends on the diameter of the resonance pipe d, the length of the resonance pipe L, and the volume of the resonance room V.

In the first resonator 21 of the present embodiment, the absorbable frequency band depends on the diameter of the resonance pipe d1, the length of the resonance pipe L1, and the volume of the resonance room V1. These characteristics are set so as to enable the absorption of the desired frequency band.

In the second resonator 22, similarly, the absorbable frequency band depends on the diameter of the resonance pipe d2, the length of the resonance pipe L2, and the volume of the resonance room V2. These characteristics are set so as to enable the absorption of the desired frequency band which differs from the frequency band set in the first resonator 21.

Thus, the resonator 8 comprises, for example, two resonators, the first resonator 21 and the second resonator 22, which are unified with each other and set so as to have different resonance frequencies f, thereby absorbing noise of two different frequency bands.

Figure 7:
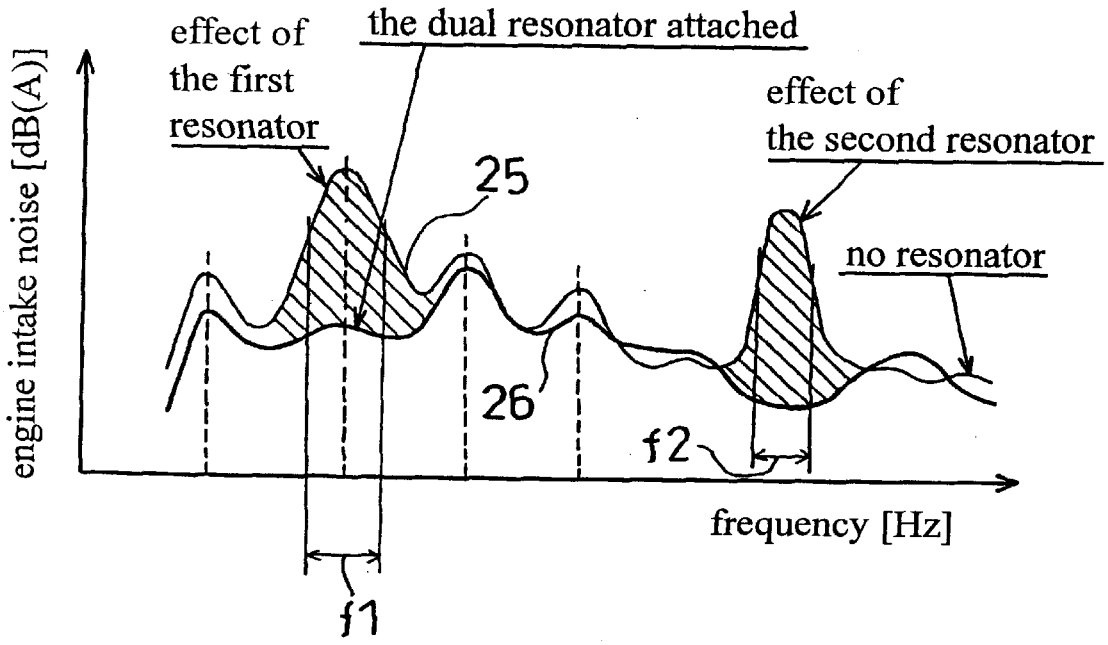
FIG. 7 is a chart of spectral characteristics of intake noise, which graphs the relationship between the frequency and the engine intake noise, showing the noise reduction effect due to the means of the present invention for arresting the engine intake noise.

FIG. 7 shows a spectrum of intake noise, which graphs the relationship between the frequency and the engine intake noise. In this graph, an intake noise spectrum 25 designates the level of the engine intake noise at every frequency in the case that the resonator 8 is not attached to the intake pipe 7. This intake noise spectrum 25 shows the higher levels of intake noise at two frequency bands f1 and f2.

Therefore, in the resonator 8, for example, the absorbable frequency band of the first resonator 21 is corresponded to the frequency band f1, and the absorbable frequency band of the second resonator 22 is corresponded to the frequency band f2, thereby absorbing the intake noise of both frequency bands f1 and f2 and reducing the intake noise level.

In the case where the so-called dual resonator 8, whose absorbable frequency bands are set to the frequency bands f1 and f2, is attached to the intake pipe 7, the intake noise levels at the frequency bands f1 and f2 are vastly reduced as shown by an intake noise spectrum 26 in FIG. 4.

Thus, since the resonator 8 comprising the first and second resonators 21 and 22 is attached to the intake pipe 7, the intake noise levels at a plurality of frequency bands can be reduced so that the engine intake noise can be reduced very well.

Furthermore, since the resonance rooms 21*a* and 22*a* of the respective first and second resonators 21 and 22 are unified, the surface area of the resonance room section 8*a* can be smaller than the total surface area in the case that the two resonance rooms 21*a* and 22*a* are formed separately from each other, thereby reducing radiant noise from the resonator 8 the better. In addition, since the space occupied by the resonator 8 and the number of components thereof can be reduced, the engine working machine 1 can be miniaturized and can be formed at low cost.

Besides, since the resonator 8 is attached to the intake pipe 7 by the two resonance pipes 21*b* and 22*b*, the rigidity which supports the resonance room section 8*a* can be improved so as to reduce the radiant noise generated from the resonator 8 by vibration of the resonance room section 8*a* and so on, and the fears of cracks in the resonance room section 8*a* and the resonance pipes 21*b* and 22*b* can be diminished so as to improve the reliabilities thereof.

In the case where the intake noise spectrum shows three frequency bands or more where the intake noise levels are high, so many resonators may be unified.

Figure 8:
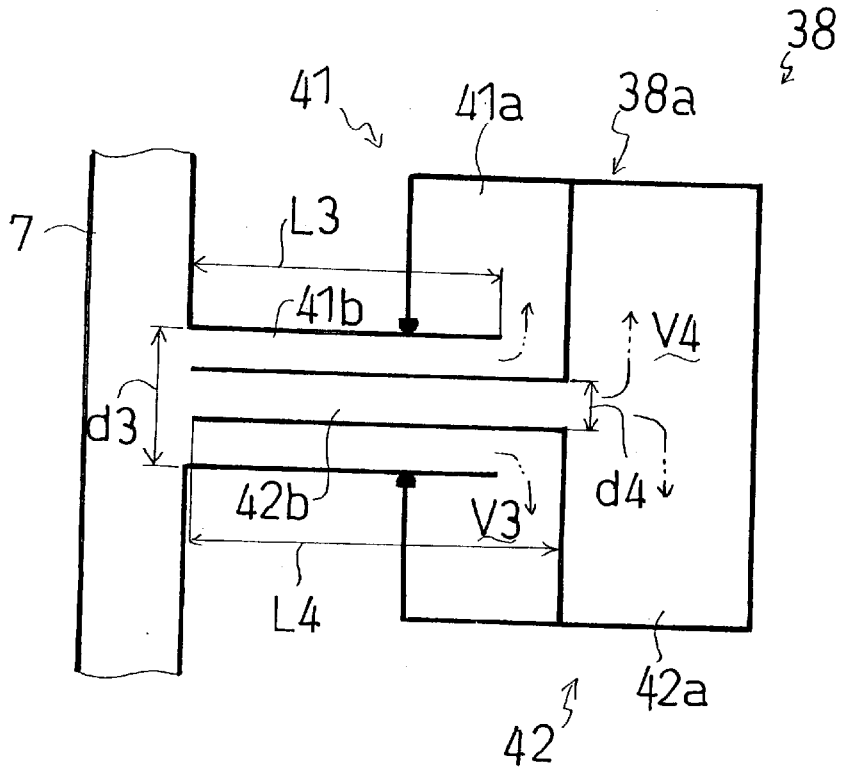
FIG. 8 is a side view showing another embodiment of the same.
Figure 9:
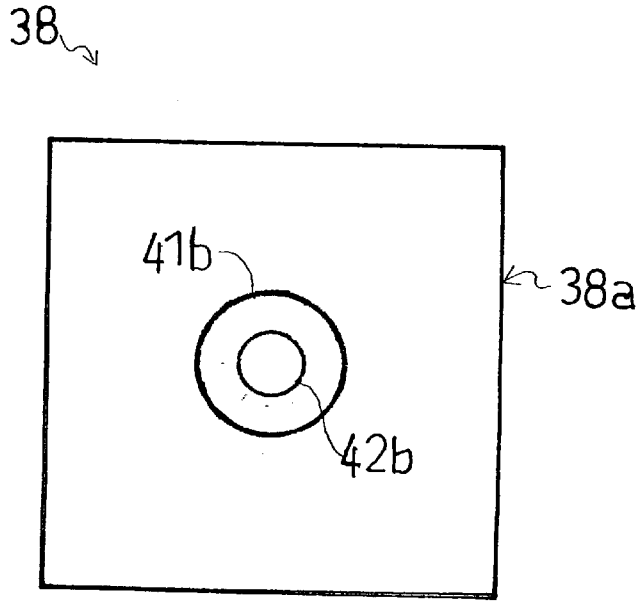
FIG. 9 is an elevation view of the same.

Next, a resonator 38 shown in FIGS. 8 and 9 as another embodiment of the resonator 8 will be described. This resonator 38 comprises a first resonator 41 and a second resonator 42 unified with each other.

The first resonator 41 comprises a resonance pipe 41*b* which extends from the intake pipe 7, and a resonance room 41*a* which is formed at the apex portion of the resonance pipe 41*b*. The second resonator 42 comprises a resonance pipe 42*b* which extends from the intake pipe 7 and pierces the resonance pipe 41*b* and the resonance room 41*a* of the first resonator 41, and a resonance room 42*a* which is formed at the apex portion of the resonance pipe 42*b*. The resonance rooms 41*a* and 42*a* are unified in a box-like shape so as to constitute a resonance room section 38*a* of the resonator 38.

The resonance pipes 41*b* and the resonance pipe 42*b*, which pierces the resonance pipe 41*b*, are formed into a double pipe.

That is to say, the resonator 38 is constructed such that the two resonance pipes 41*b* and 42*b* are multiplexed or formed as a double pipe and projected from the resonance room section 38*a* as the unified resonance rooms 41*a* and 42*a*. The resonator 38 is joined to the intake pipe 7 by connecting the resonance pipes 41*b* and 42*b* to the intake pipe 7.

The absorbable frequency band of the first resonator 41 depends on the diameter of the resonance pipe d3, the length of the resonance pipe L3, and the volume of the resonance room V3. These characteristics are set so as to enable the absorption of the desired frequency band.

Similarly, the absorbable frequency band of the second resonator 42 depends on the diameter of the resonance pipe d4, the length of the resonance pipe L4, and the volume of the resonance room V4. These characteristics are set so as to enable the absorption of the desired frequency band which differs from the frequency band set in the first resonator 41.

Thus, for example, the resonator 38 comprises two unified resonators, the first and second resonators 41 and 42, which have respective different resonance frequencies f so as to absorb noise of two different frequency bands, thereby exerting an excellent effect of reducing noise similarly with the above-mentioned resonator 8.

This resonator 8 can have advantages in reduction of radiant noise from the resonator 38 because of the unified resonance rooms 41*a* and 41*b*, and in miniaturization and cost-saving of the engine working machine 1, similarly with the former resonator 8.

According to the manner like that in the resonator 38, a resonator comprising three unified resonance rooms or more and a triple-or-more-bonded pipe may be formed.

Possibility of Industrial Application

The package storing type engine working machine according to the present invention, which generates little noise due to the above-mentioned structure, is useful for various purposes such as electric power generation, pump-driving or compressor-driving at a place where silence is required.

What is claimed is:

1. A low noise engine working machine formed by storing a radiator and a cooling fan for leading heat exchange air for the radiator in a package together with an engine and a working machine, the package comprising:

a storing space for the engine and the working machine;

a ventilating port communicating to a space between the radiator and the cooling fan;

an air leading space to which air is led after being passed through the radiator by the cooling fan, wherein the storing space excluding the ventilating port is shielded from the air leading space; and a cooling air leading port for externally cooling the engine and the working machine, wherein outside air led from the cooling air leading port passes the storing space and is exhausted from the ventilating port to the air leading space.

* * * * *